US006406664B1

(12) United States Patent
Diamond

(10) Patent No.: US 6,406,664 B1
(45) Date of Patent: Jun. 18, 2002

(54) SILVER GERMANIUM ALLOY

(76) Inventor: Lawrence H. Diamond, 692 Mildred St., Teaneck, NJ (US) 07666

( * ) Notice: Subject to any disclaimer, the term of this patent is extended or adjusted under 35 U.S.C. 154(b) by 0 days.

(21) Appl. No.: 09/640,106

(22) Filed: Aug. 15, 2000

Related U.S. Application Data

(60) Provisional application No. 60/148,739, filed on Aug. 16, 1999.

(51) Int. Cl.[7] ..... C22C 5/08
(52) U.S. Cl. ..... 420/502
(58) Field of Search ..... 420/502; 148/430

(56) References Cited

U.S. PATENT DOCUMENTS 2,947,623 A * 8/1960 Lincoln ..... 75/165
5,972,131 A * 10/1999 Asada et al. ..... 148/430

FOREIGN PATENT DOCUMENTS

| | | | |
|---|---|---|---|
| CN | 1073292 A | * | 6/1993 |
| DE | 1296493 B | * | 5/1969 |
| GB | 2283934 A | * | 5/1995 |
| JP | 6106227 A | * | 1/1986 |
| JP | 6134144 A | * | 2/1986 |
| JP | 452238 A | * | 2/1992 |
| RU | 561744 A | * | 11/1977 |

* cited by examiner

*Primary Examiner*—Roy King
*Assistant Examiner*—Nicole Coy
(74) *Attorney, Agent, or Firm*—Charles E. Temko

(57) ABSTRACT

A fire stain and tarnish resistance silver composition containing germanium, tin, and trace amounts of boron and nickel, as well as copper.

1 Claim, No Drawings

SILVER GERMANIUM ALLOY

RELATED APPLICATION

Reference is made to my copending provisional application, Ser. No. 60/148,739 filed Aug. 16, 1999 for which priority is claimed.

BACKGROUND OF THE INVENTION

This invention relates generally to the field of metallic alloys, and more particularly, to an improved silver germanium alloy having improved grain and working properties using smaller proportions of relatively expensive component ingredients while improving workability.

The alloying of silver with germanium, together with trace amounts of boron used as a grain refiner together with copper is known, and described in UK Patent No. 2,283,934. The principal use of the disclosed alloy is in the field of jewelry, and the use of such alloys, inter alia permits the interconnection of component parts of jewelry by a preferred diffusion process.

While silver is not relatively inexpensive, germanium is considerably more expensive, making it desirable to reduce the amount of germanium required to make a useful alloy which can be used for many purposes. In the above-identified disclosure, typically, the content of germanium ranges from 0.4% by weight to 0.7%. I have determined that the amount of germanium required can be reduced by the use of substantial amounts of tin, with or without the use of trace amounts of nickel. Not only is the cost of manufacture of the alloy reduced, but the resultant product can be used in the manufacture of many products using known mechanical processes.

SUMMARY OF THE INVENTION

Briefly stated, the invention contemplates the provision of an improved silver alloy of the type described which affords improved working qualities and which can be age hardened, soldered, welded, formed, cast and mechanically worked. The product does not shrink, is non-porous, and exhibits no fire scale as a result of processing involving elevated temperatures.

The following examples are illustrative. Proportions are by weight.

EXAMPLE 1

| | |
|---|---|
| Silver | 92.5% |
| Germanium | 0.1% |
| Tin | 1.8% |
| Boron | .001% |
| Nickel | .006% |
| Copper | 5.59% |

EXAMPLE 2

| | |
|---|---|
| Silver | 92.5% |
| Germanium | .3% |
| Tin | 1.5% |
| Boron | .0015% |

-continued

| | |
|---|---|
| Nickel | .009% |
| Copper | 5.69% |

EXAMPLE 3

| | |
|---|---|
| Silver | 92.5% |
| Germanium | .30% |
| Tin | 1.4% |
| Boron | .0015% |
| Nickel | .01% |
| Copper | 5.71% |

EXAMPLE 4

| | |
|---|---|
| Silver | 96.5% |
| Germanium | .38% |
| Tin | 1.00% |
| Boron | 0.003% |
| Nickel | 0.050% |
| Copper | 2.067% |

EXAMPLE 5

| | |
|---|---|
| Silver | 93.5% |
| Germanium | 0.10% |
| Tin | 0.95% |
| Boron | 0.004% |
| Nickel | 0.070% |
| Copper | 5.376% |

EXAMPLE 6

| | |
|---|---|
| Silver | 92.5% |
| Germanium | 0.38% |
| Tin | 1.3% |
| Boron | 0.008% |
| Nickel | 0.080% |

In all of the above examples, initial fabrication was performed in an inert or reducing environment. In both casting and rod processes, no shrinking, porosity, or fire scale were observed in the finished product.

While the use of germanium, and trace amounts of boron as a grain refiner are known, it is believed that the combination of germanium in reduced amounts, with relatively large amounts of tin, and trace amounts of nickel, result in a product which is superior to known silver germanium alloys. The combination apparently reduces the oxidation of the copper component at high temperatures, resulting in the elimination of fire scale. while the above-described examples were conducted in an inert or reducing atmosphere, it is believed that an improved result can be obtained in normal atmosphere as well.

I wish it to be understood that I do not consider the invention to be limited to the precise details set forth in the examples, for obvious modifications will occur to those skilled in the art to which the invention pertains.

I claim:

1. A silver alloy consisting approximately by weight of:

| | |
|---|---|
| Silver | 92.5%–96.6% |
| Germanium | 0.1%–0.38% |
| Tin | 0.5%–2.2% |
| Boron | 0.001%–0.008% |

-continued

| | |
|---|---|
| Nickel | 0.001%–.100% |
| Copper | Balance |

* * * * *